US005398584A

United States Patent [19]

Liao

[11] Patent Number: 5,398,584

[45] Date of Patent: Mar. 21, 1995

[54] STRUCTURE OF BEATER AMPLITUDE ADJUSTMENT DEVICE FOR THE PEDAL MECHANISM OF A BASE DRUM

[75] Inventor: Tsun-Chi Liao, Taichung, Taiwan, Prov. of China

[73] Assignee: Hwa Shin Musical Instrument Co., Ltd., Taichung, Taiwan, Prov. of China

[21] Appl. No.: 275,610

[22] Filed: Jul. 15, 1994

Related U.S. Application Data

[63] Continuation-in-part of Ser. No. 120,513, Sep. 14, 1993, Pat. No. 5,343,792.

[51] Int. Cl.[6] ..... G10D 13/02

[52] U.S. Cl. ..... 84/422.1

[58] Field of Search ..... 84/422.1, 422.2

[56] References Cited

U.S. PATENT DOCUMENTS

| | | | |
|---|---|---|---|
| 4,819,536 | 4/1989 | Lombardi | 84/422.1 |
| 5,297,467 | 3/1994 | Hoshino | 84/422.1 |
| 5,343,792 | 9/1994 | Liao | 84/422.1 |

*Primary Examiner*—Michael L. Gellner
*Assistant Examiner*—Patrick J. Stanzione
*Attorney, Agent, or Firm*—Bacon & Thomas

[57] ABSTRACT

A base drum beater amplitude adjustment device including a beater holder fixed to a revolving shaft of the pedal mechanism of a base drum to hold a beater, a flywheel consisting of two opposing parts joined together by screws and driven to turn the revolving shaft back and forth, and a locating device made of a split cylinder mounted around the polygonal revolving shaft and held down by the flywheel to stop the revolving shaft from rotary motion relative to the flywheel, wherein the angular position of the beater is adjusted by loosening the screws and turning the revolving shaft relative to the flywheel.

1 Claim, 4 Drawing Sheets

STRUCTURE OF BEATER AMPLITUDE ADJUSTMENT DEVICE FOR THE PEDAL MECHANISM OF A BASE DRUM

CROSS-REFERENCE TO RELATED APPLICATION

The present invention is a continuation-in-part of U.S. patent application Ser. No. 08/120,513, "BEATER AMPLITUDE ADJUSTMENT DEVICE FOR THE BASE DRUM PEDAL MECHANISM OF A BASE DRUM", now U.S. Pat. No. 5,343,792.

BACKGROUND OF THE INVENTION

The pedal mechanism of a base drum as shown in FIG. 1, is generally comprised of two upright supports upstanding from a base frame to hold a revolving shaft in a horizontal position by bearings, a flywheel mounted around the revolving shaft, a pedal having one end hinged to the base frame and an opposite end connected to the flywheel by a chain, a beater holder fixed to the flywheel to hold a beater by a screw. As the pedal is pressed by the foot, the chain is pulled downward to turn the flywheel, causing the beater to hit the drum. The amplitude of the beater is controlled by a cam mechanism. The cam mechanism is comprised of an inner cam fixed to the revolving shaft, an outer cam engaged with the inner cam and coupled with a hanging ring, a spring having a top end suspended from the hanging ring and a bottom end fastened to the locating member at an outer side by one upright support. The spring is provided to return the beater and the pedal back to their former positions after each strike. The procedure to adjust the amplitude of the beater is done by loosening the cam mechanism, then turning the revolving shaft to change the angular position of the heater holder. When adjusted, the cam mechanism is fastened tight again. As the angular position of the beater holder is adjusted, the elevation of the free end of the pedal is relatively adjusted. When the free end of the pedal is lifted higher, more effort should be employed to the pedal to pull the chain and turn the flywheel. Due to the limitation of the chain, the adjustable range of the amplitude of the beater is limited, and therefore the quality of the drum cannot be fully carried out.

In order to eliminate the aforesaid drawbacks, the present invention invented a beater amplitude adjustment device for the base drum pedal mechanism of a base drum and applied for a patent under U.S. patent application Ser. No. 08/120,513. This adjustment device is comprised of a beater holder mounted around the revolving shaft of the pedal mechanism of a base drum to hold a beater, and a locating device made of a split cylinder and fastened around the revolving shaft to retain the beater holder in position. The beater holder consists of two opposing parts connected together around the locating device by screw bolts. The angular position of the beater is adjusted by loosening the screw bolts, then turning the beater holder to the desired angular position around the locating device, and then fastening tight the screw bolts again.

SUMMARY OF THE INVENTION

The present invention provides an improved structure of beater amplitude adjustment device which can be adjusted to change the angular position of the beater of the pedal mechanism without changing the elevation of the pedal or turning the angle of the beater or beater holder relative to the revolving shaft. According to the present invention, the beater amplitude adjustment device comprises a flywheel consisting of two opposing parts joined together by screws and driven to turn a revolving shaft back and forth, and a locating device made of a split cylinder mounted around the polygonal revolving shaft and held down by the flywheel to stop the revolving shaft from rotary motion relative to the flywheel. The angular position of the beater, which is mounted on a beater holder fixedly mounted on the revolving shaft, is adjusted by loosening the screws and turning the revolving shaft relative to the flywheel.

DETAILED DESCRIPTION OF THE PREFERRED EMBODIMENT

Figure 1:
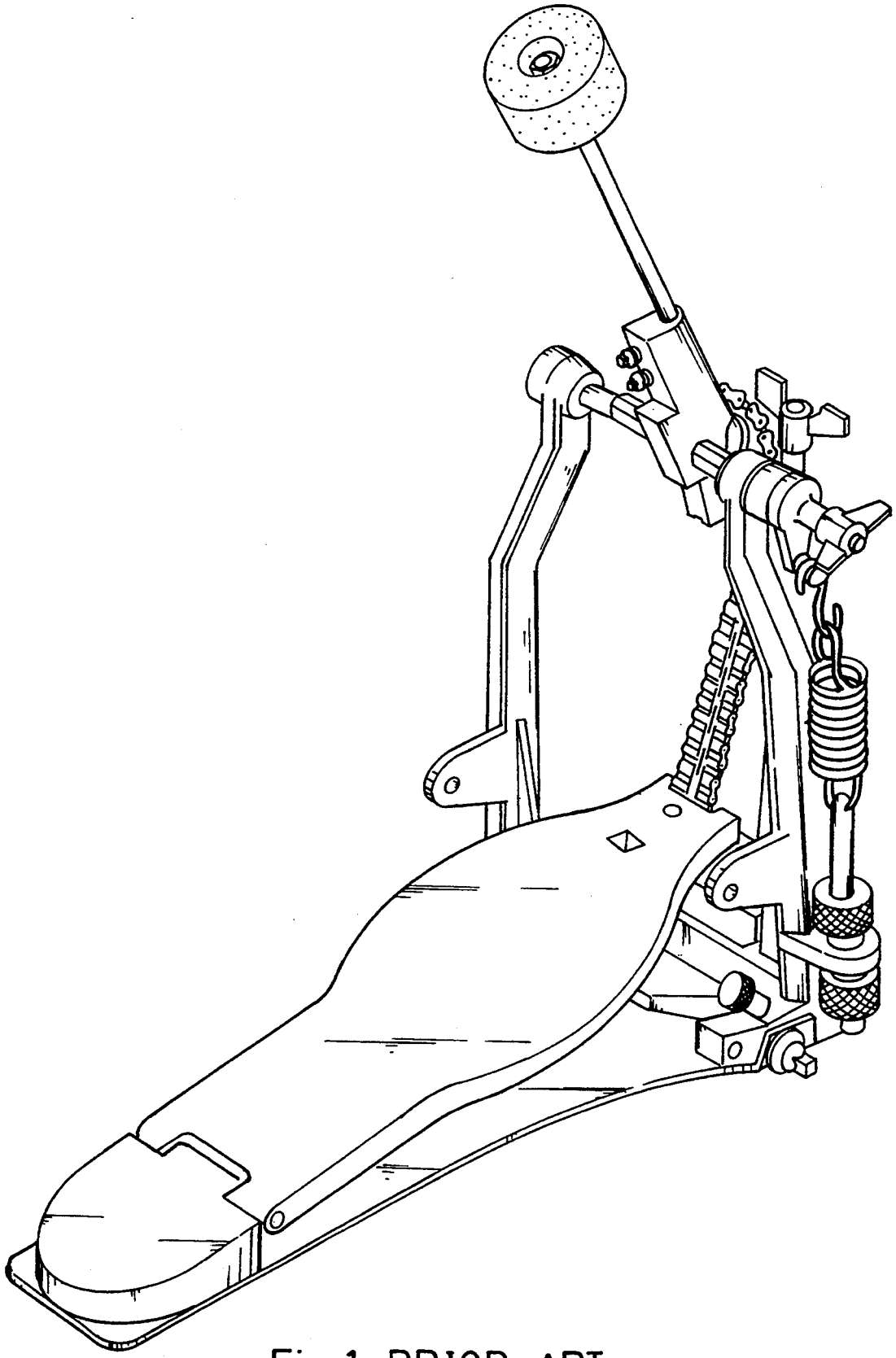
Fig.1 PRIOR ART
FIG. 1 is an elevational view of a base drum pedal mechanism according to the prior art.
Figure 2:
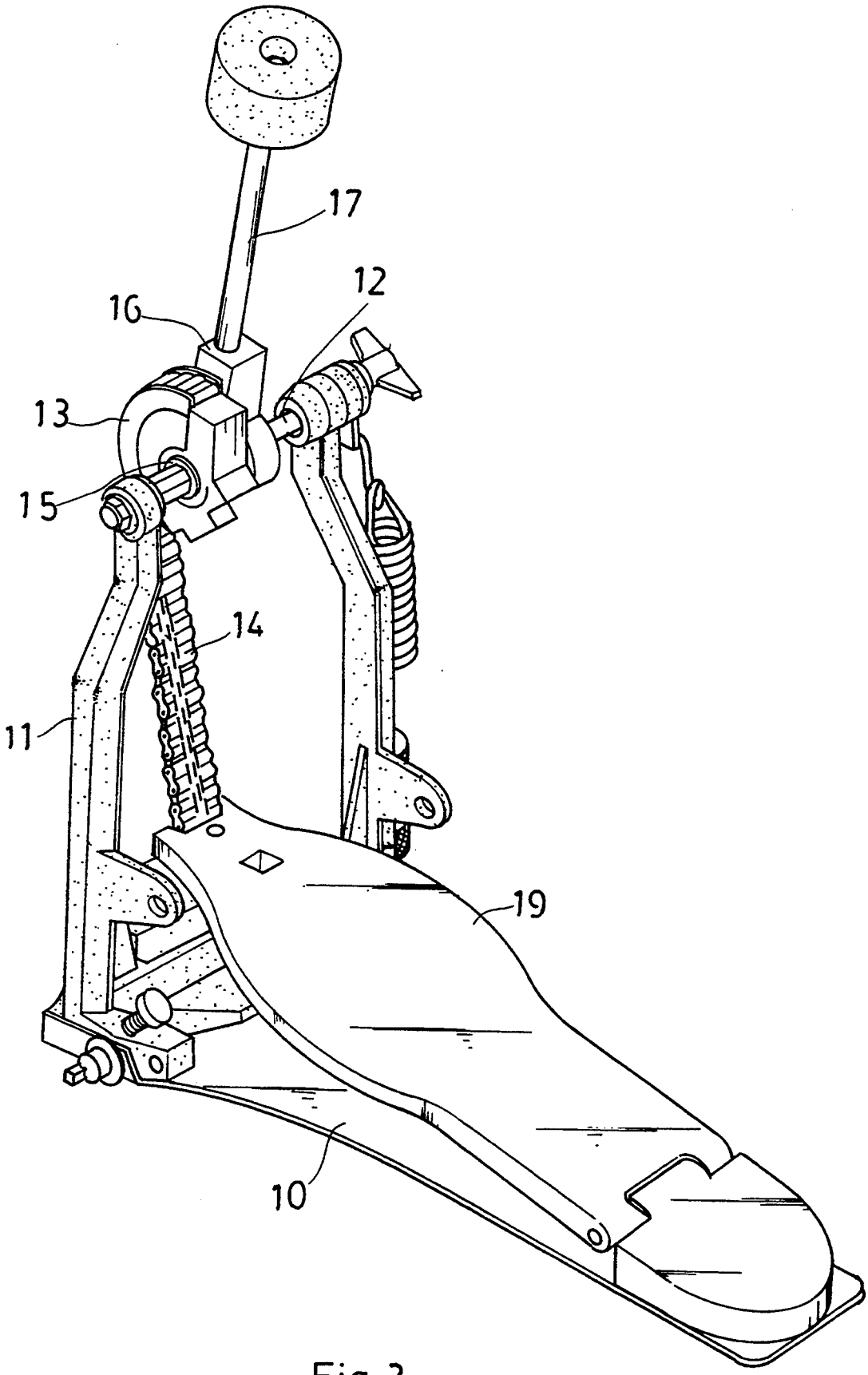
FIG. 2 is an elevational view of a base drum pedal mechanism installed with a beater amplitude adjustment device according to the present invention.
Figure 3:
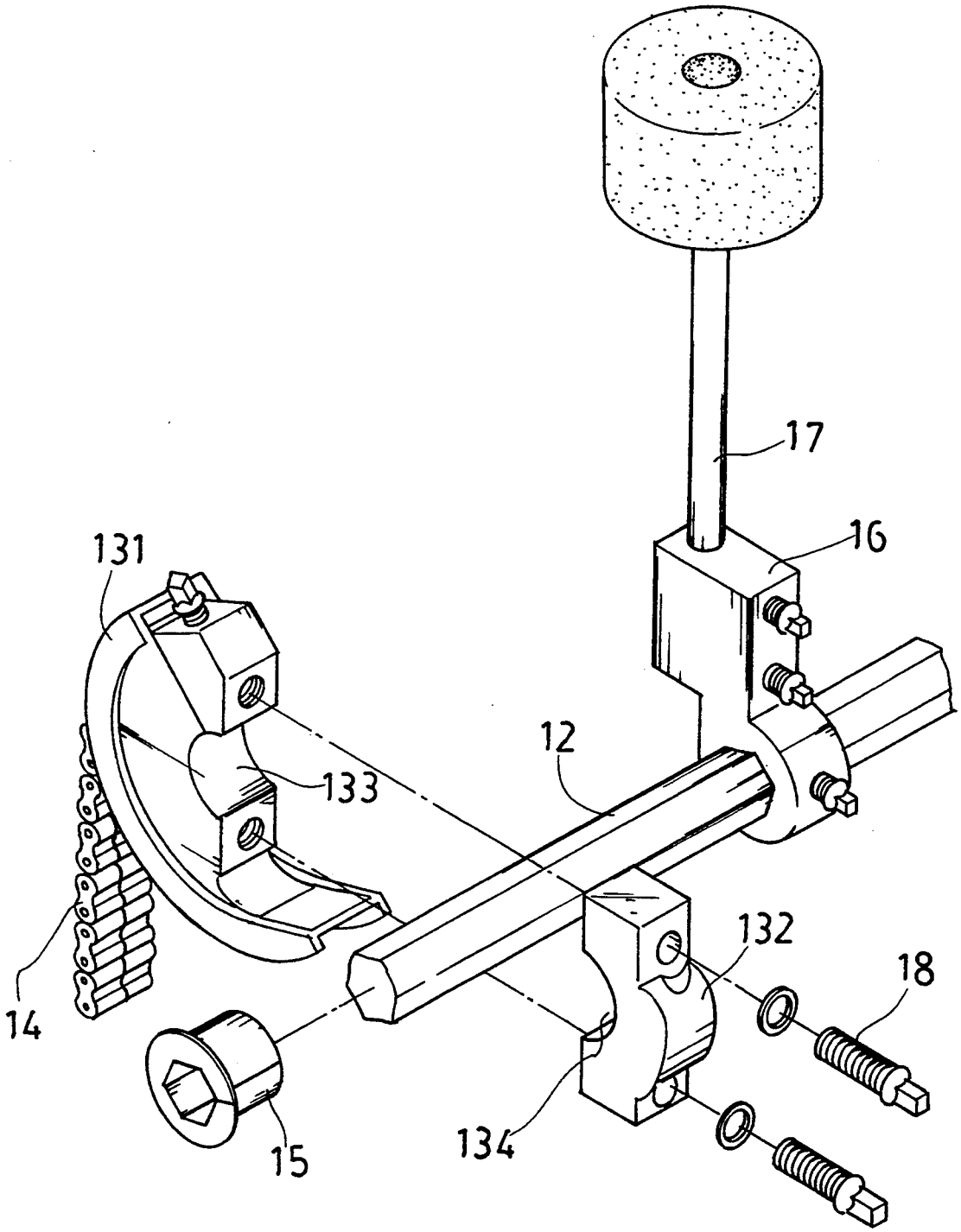
FIG. 3 is an exploded view of the beater amplitude adjustment device shown in FIG. 2.

Referring to FIGS. 2 and 3, a base drum pedal mechanism is shown comprised of a base frame 10, two upright supports 11 raised from the front end of the base frame 10, a revolving shaft 12 transversely supported between the upright supports 11, a flywheel 13 mounted around the revolving shaft 12, a pedal 19 having one end hinged to the base frame 10 and an opposite end connected to the flywheel 13 by a chain 14, a beater holder 16 fixed to the revolving shaft 12, a locating device 15 mounted around the revolving shaft 12 to retain the beater holder 16 in position, and a beater 17 mounted on the beater holder 16. The locating device 15 is made from a split cylinder fitted around the polygonal cross section of the revolving shaft 12. The flywheel 13 is comprised of two opposing parts, namely, a flywheel body block 131 and a locating block 132 connected together by screws 18. The flywheel body block 131 has a half-round recess 133. The locating block 132 has a half-round recess 134 corresponding to the half-round recess 133 on the flywheel body block 131. As the flywheel body block 131 and the locating block 132 are connected together, the half-round recesses 133 and 134 are linked and formed into a round hole, which receives the locating device 15 and the revolving shaft 12. As the screws 18 are fastened tight, the flywheel 13 is fixed to the revolving shaft 12, i.e., the beater holder 16 and the beater 17 are fixed at the desired angular position relative to the pedal 19. By loosening the screws 18, the revolving shaft 12 can be turned relative to the flywheel 13 to change the angular position of the beater 17 relative to the pedal 19. When adjusted, the screws 18 are tightened up again to fix the revolving shaft 12 and the locating device 15 to the flywheel 13.

Figure 4:
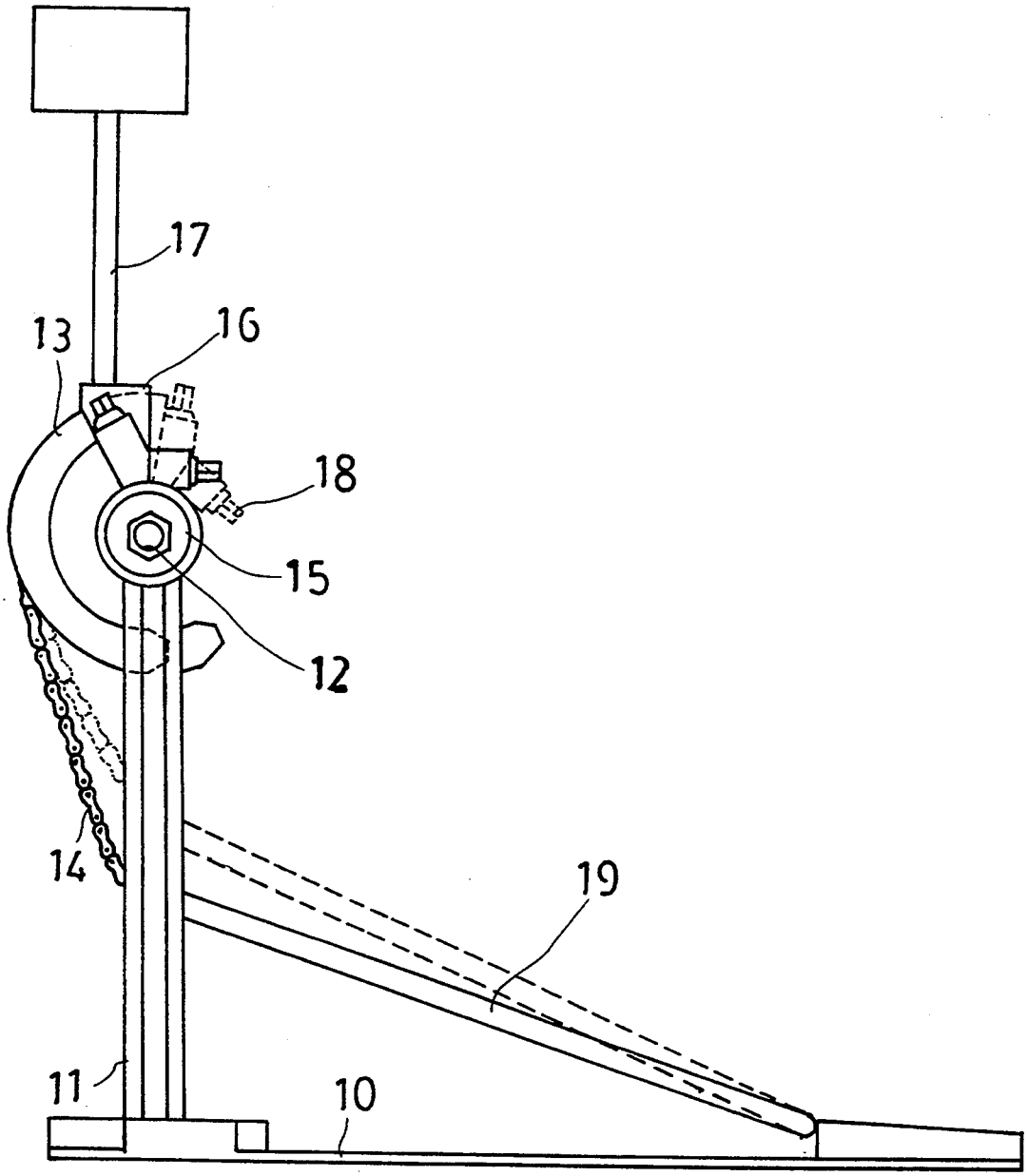
FIG. 4 is a schematic drawing showing the beater amplitude adjustment device of FIG. 2 adjusted.

Referring to FIG. 4, as the leg stepped on the pedal 19, the flywheel 13 is turned clockwise, and the revolving shaft 12 is synchronously moved to turn the beater holder 16 causing the beater 17 to strike the base drum (not shown).

I claim:

1. A base drum beater amplitude adjustment device for adjusting the amplitude of the beater of a base drum, the adjustment device comprising a revolving shaft supported between two upright supports on the base frame of the pedal mechanism of a base drum and having a polygonal cross section, a beater holder fixed to said revolving shaft to hold a beater, a flywheel mounted around said revolving shaft, and a locating device fastened between said flywheel and said revolving shaft to stop said revolving shaft from rotary movement relative to said flywheel, wherein said flywheel comprises two opposing parts joined together by screws to hold down said locating device around said revolving shaft permitting said revolving shaft to be turned back and forth by said flywheel; said revolving shaft can be turned relative to said flywheel to adjust the angular position of said beater relative to the pedal of the pedal mechanism of the base drum when said screws are loosened.

* * * * *